US008967133B1

(12) United States Patent
Huang

(10) Patent No.: US 8,967,133 B1
(45) Date of Patent: Mar. 3, 2015

(54) TWO AXIS MICRO-ADJUSTING DEVICE WITH A SINGLE LOCKING MECHANISM

(76) Inventor: Dorge O. Huang, Henry, IL (US)

( * ) Notice: Subject to any disclaimer, the term of this patent is extended or adjusted under 35 U.S.C. 154(b) by 456 days.

(21) Appl. No.: 13/438,894

(22) Filed: Apr. 4, 2012

(51) Int. Cl.
*F41B 5/00* (2006.01)

(52) U.S. Cl.
USPC ..... 124/88

(58) Field of Classification Search
CPC ..... F41B 5/1403; F41B 5/066; F41B 5/148; F41B 5/1492; F41G 11/001; F41G 11/004
USPC ..... 124/88
See application file for complete search history.

(56) References Cited

U.S. PATENT DOCUMENTS 5,984,291 A * 11/1999 Iwata et al. ..... 269/73
7,614,805 B2 * 11/2009 Showalter ..... 396/428

* cited by examiner

*Primary Examiner* — Alvin Hunter
*Assistant Examiner* — Amir Klayman
(74) *Attorney, Agent, or Firm* — Donald J. Ersler

(57) ABSTRACT

A two axis micro-adjusting device with a single locking mechanism preferably includes a mounting base, a first axis adjustment housing and a second axis adjustment nut. The mounting base includes a second axis housing and an attachment bracket. The first axis adjustment housing is slidably retained on the second axis housing. An end of the first axis adjustment bar is secured to a first object. The attachment bracket is attached to a second object. Rotation of a first axis adjustment screw adjusts the first axis adjustment bar in the first axis adjustment housing. Rotation of a second axis adjustment screw adjusts the second axis adjustment nut in the second axis housing. A locking fastener is tightened to lock the position of the first axis and second axis adjustments.

17 Claims, 5 Drawing Sheets

TWO AXIS MICRO-ADJUSTING DEVICE WITH A SINGLE LOCKING MECHANISM

BACKGROUND OF THE INVENTION

1. Field of the Invention

The present invention relates generally to hunting and more specifically to a two axis micro-adjusting device with a single locking mechanism, which allows two-axis adjustment of an object to be secured with a single locking mechanism.

2. Discussion of the Prior Art

It appears that the prior art does not disclose a two axis micro-adjusting device with a single locking mechanism, which allows two axis adjustment of a first object, such as an arrow rest relative to a second object, such as an archery bow to be secured with a single locking mechanism, such as a screw.

Accordingly, there is a clearly felt need in the art for a two axis micro-adjusting device with a single locking mechanism, which allows two axis adjustment of a first object, such as an arrow rest relative to a second object, such as an archery bow to be secured with a single locking mechanism, such as a screw.

SUMMARY OF THE INVENTION

The present invention provides a two axis micro-adjusting device with a single locking mechanism, which allows two-axis adjustment of an object to be secured with a single locking mechanism. The two axis micro-adjusting device with a single locking mechanism (two axis adjustment device) preferably includes a mounting base, a first axis adjustment housing, a first axis adjustment bar, a second axis adjustment nut, a first axis adjustment screw, a second axis adjustment screw and a locking fastener. The mounting base includes a second axis housing and an attachment bracket extending from a bottom of the second axis housing. The attachment bracket is attached to a second object, such as an archery bow. The second axis adjustment nut is slidably retained in the second axis housing. The first axis adjustment housing is slidably retained on a top of the second axis housing and the second axis adjustment nut is secured with the locking fastener. The first axis adjustment housing includes an adjustment bar guide opening, and a screw pedestal for rotatably retaining the first axis adjustment screw. Rotation of the first axis adjustment screw causes axial movement of the first axis adjustment bar. Rotation of the second axis adjustment screw causes axial movement of the second axis adjustment nut. The first object, such as an arrow rest is secured to an end of the first axis adjustment bar with a fastener or the like. Once the first and second axis adjustments are made through the first and second axis adjustment screws, the locking fastener is tightened to lock the first and second axis adjustments.

Accordingly, it is an object of the present invention to provide a two axis micro-adjusting device with a single locking mechanism, which allows two axis adjustment of a first object, such as an arrow rest relative to a second object, such as an archery bow to be secured with a single locking mechanism, such as a screw.

These and additional objects, advantages, features and benefits of the present invention will become apparent from the following specification.

DETAILED DESCRIPTION OF THE PREFERRED EMBODIMENTS

Figure 1:
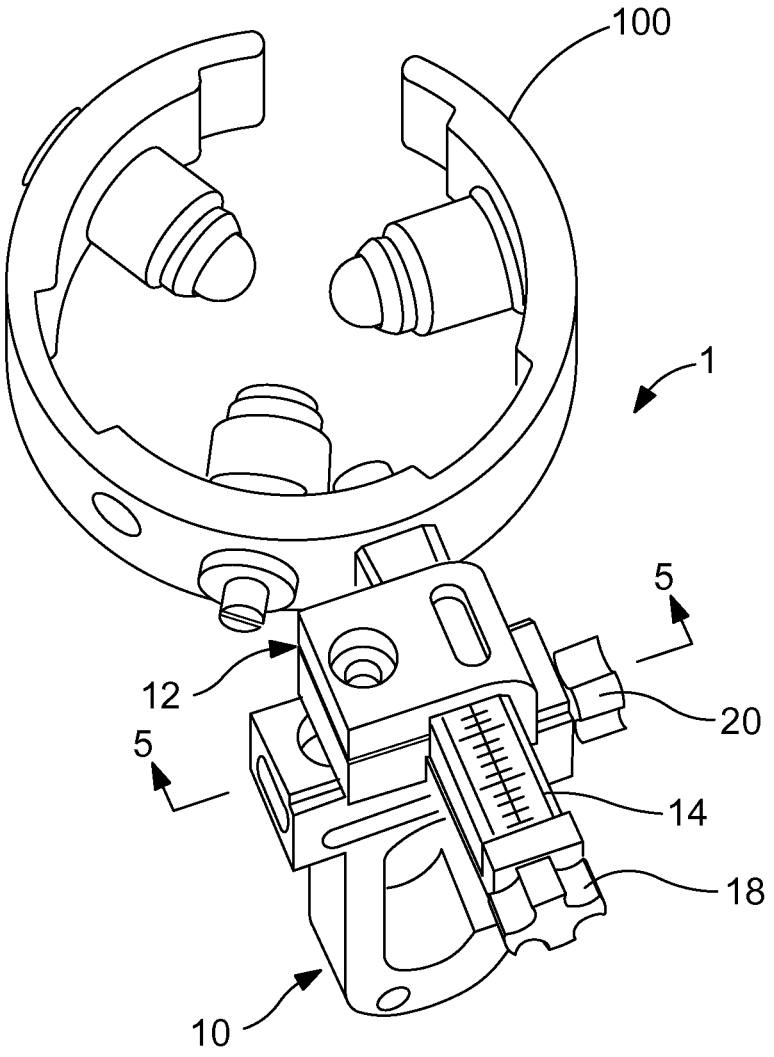
FIG. 1 is a perspective view of a two axis adjustment device attached to an arrow rest in accordance with the present invention.
Figure 2:
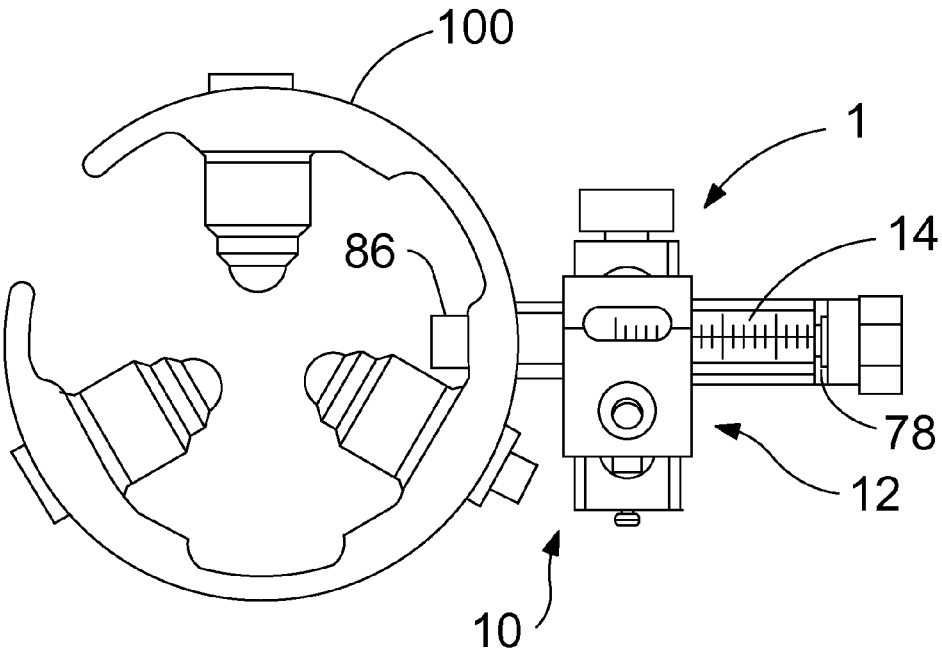
FIG. 2 is a front view of a two axis adjustment device attached to an arrow rest in accordance with the present invention.
Figure 5:
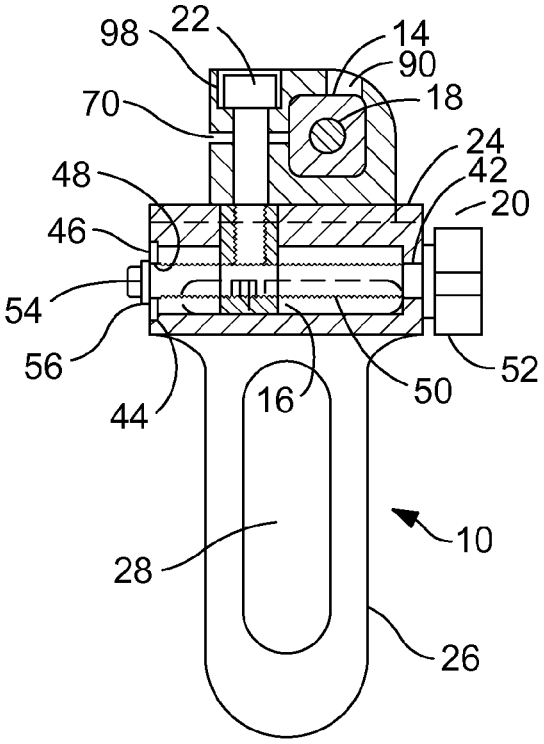
FIG. 5 is a cross-sectional view of a two axis adjustment device cut through FIG. 1 in accordance with the present invention.
Figure 6:
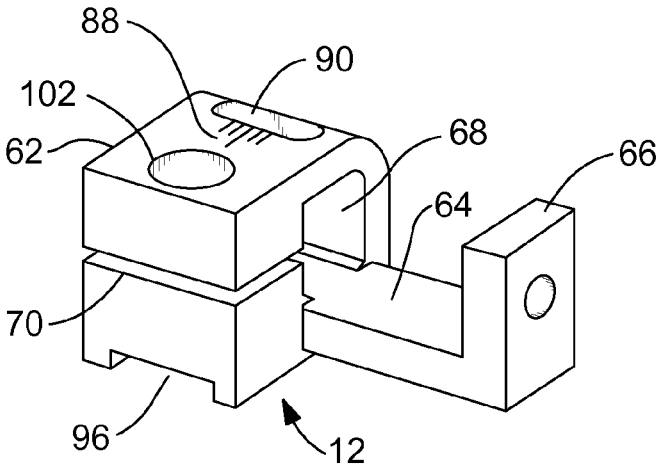
FIG. 6 is a perspective view of a first axis adjustment housing of a two axis adjustment device in accordance with the present invention.
Figure 7:
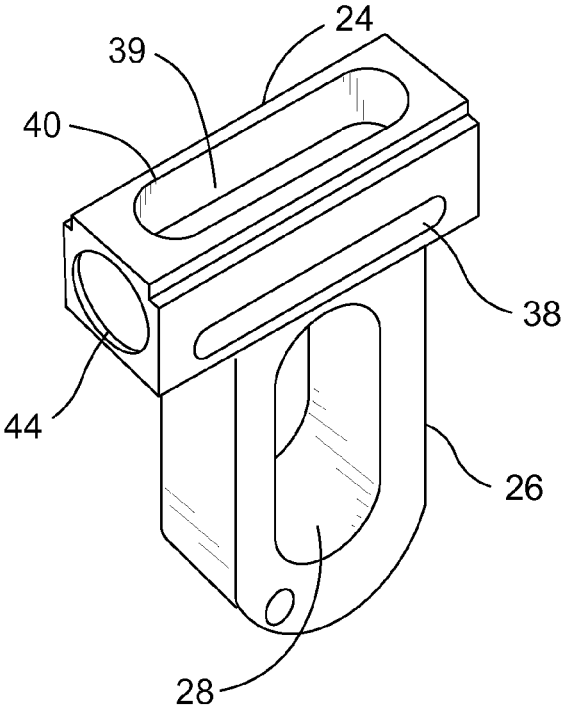
FIG. 7 is a perspective view of a mounting base of a two axis adjustment device in accordance with the present invention.
Figure 9:
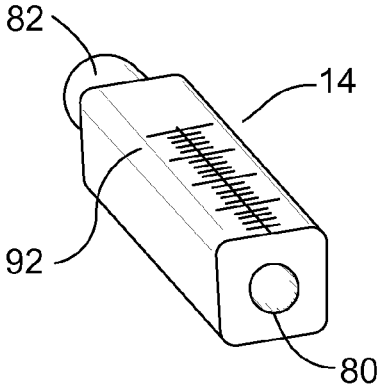
FIG. 9 is a perspective view of a first axis adjustment bar of a two axis adjustment device in accordance with the present invention.
Figure 10:
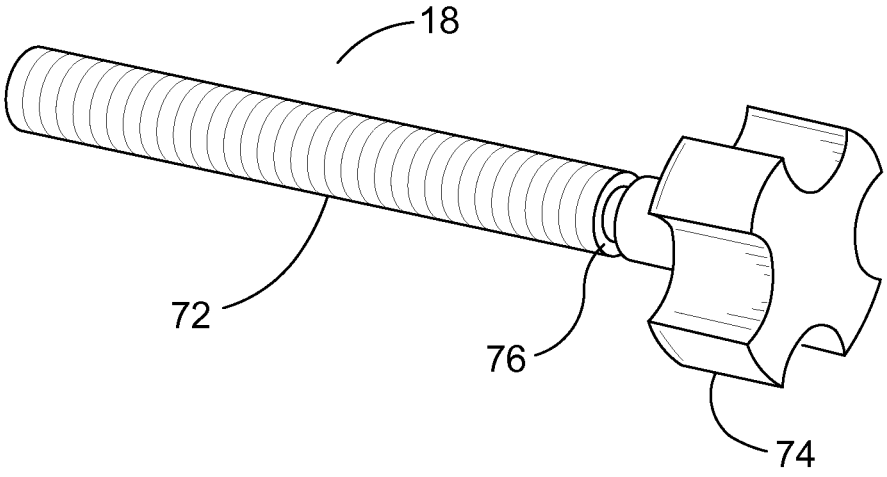
FIG. 10 is a perspective view of a first axis adjustment screw of a two axis adjustment device in accordance with the present invention.

With reference now to the drawings, and particularly to FIG. 1, there is shown a perspective view of a two axis adjustment device 1. With reference to FIGS. 2-10, the two axis adjustment device 1 preferably includes a mounting base 10, a first axis adjustment housing 12, a first axis adjustment bar 14, a second axis adjustment nut 16, a first axis adjustment screw 18, a second axis adjustment screw 20 and a locking fastener 22. With reference to FIGS. 5 and 7, the mounting base 10 includes a second axis housing 24 and an attachment bracket 26. The attachment bracket 26 extends from a bottom of the second axis housing 24. The attachment bracket 26 includes an attachment slot 28 formed through a middle thereof. The attachment bracket 26 is attached to a second object, such as an archery bow with a fastener (not shown) or the like inserted through the attachment slot 28 and secured to the second object.

Figure 8:
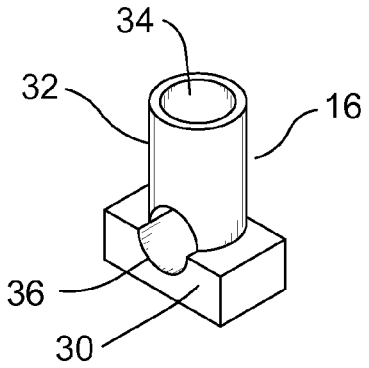
FIG. 8 is a perspective view of a second axis adjustment nut of a two axis adjustment device in accordance with the present invention.

With reference to FIGS. 5 and 8 the second axis adjustment nut 16 includes a rectangular base 30 and a nut post 32 extending upward from a top of the rectangular base 30. A threaded tap 34 is formed in the nut post 32 for retention of the locking fastener 22. A second axis threaded hole 36 is formed through a junction between the rectangular base 30 and the nut post 32 to threadably receive the second axis adjustment screw 20. The second axis threaded hole 36 is perpendicular to the threaded tap 34. The second axis housing 24 includes two opposing side block slots 38, 39 and a top nut slot 40. The two opposing side block slots 38, 39 and the top nut slot 40 are sized to slidably receive the second axis adjustment nut 16. The rectangular base 30 is inserted through the top nut slot 40 and rotated 90 degrees to engage the two opposing side block slots 38, 39.

Figure 3:
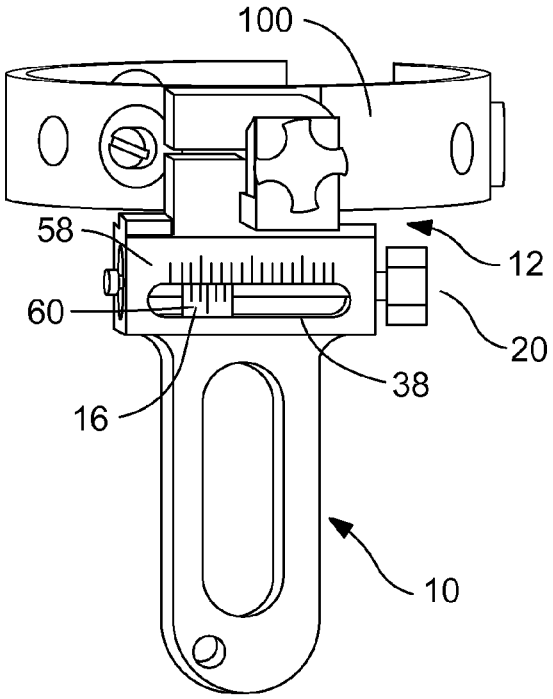
FIG. 3 is an end view of a two axis adjustment device attached to an arrow rest in accordance with the present invention.
Figure 4:
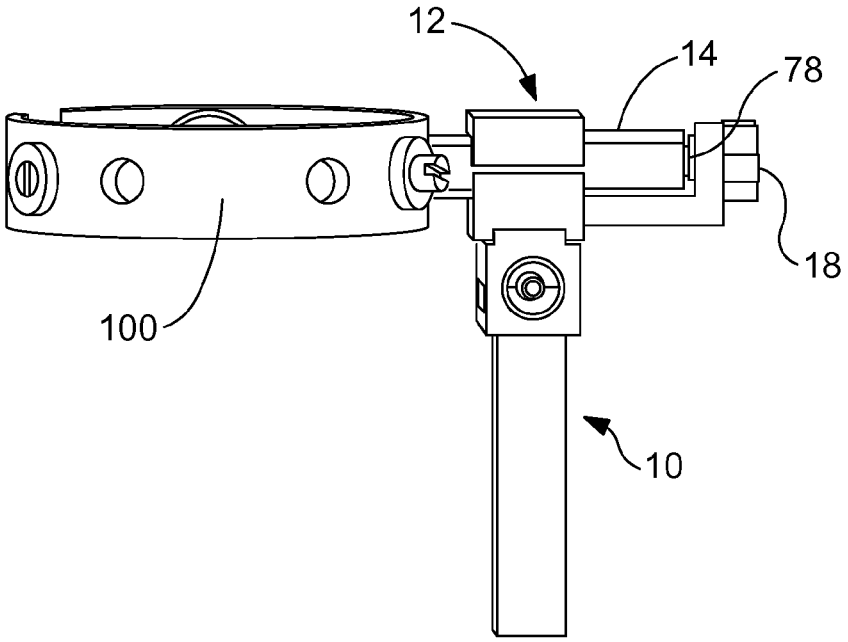
FIG. 4 is a side view of a two axis adjustment device attached to an arrow rest in accordance with the present invention.

A second axis screw hole 42 is formed in one end of the second axis housing 24 to rotatably receive one end of the second axis adjustment screw 20 and a second axis counterbore 44 is formed in an opposing end of the second axis housing 24 to receive a second axis support washer 46. The second axis support washer 46 includes a screw hole 48, which is sized to receive the other end of the second axis adjustment screw 20. The second axis adjustment screw 20 includes a threaded shaft 50, which extends from a knob 52. The threaded shaft 50 is sized to threadably engage the second axis threaded hole 36 of the second axis adjustment nut 16. A retention groove 54 is formed in the other end of the second axis adjustment screw to receive a snap clip 56. The snap clip 56 prevents axially movement of the second axis adjustment screw 20 relative to the second axis housing 24. Rotation of the second axis adjustment screw 20 moves the second axis adjustment nut 16 relative to the second axis housing 24. With reference to FIG. 3, second axis adjustment indicia 58 is formed on a side of the second axis housing 24, above the side block slot 38. Nut adjustment indicia 60 is formed on an end of the rectangular base 30 of the second axis adjustment nut 16.

The first axis adjustment housing 12 includes a bar base 62, a pedestal extension 64 and a screw pedestal 66. The bar base 62 includes an adjustment bar guide opening 68. A clamp slit 70 is formed through an outer perimeter of the bar base 62 to the bar guide opening 68. One end of the pedestal extension 64 extends from the bar base 62 and the screw pedestal 66 extends upward from the other end of the pedestal extension 64. The first axis adjustment screw 18 includes a threaded shaft 72, which extends from a knob 74. A snap ring groove 76 is formed in one end of the first axis adjustment screw 18 to receive a snap ring 78. The snap ring 78 prevents axially movement of the first axis adjustment screw 18 relative to the first axis adjustment housing 12.

The first axis adjustment bar 14 includes a threaded hole 80 formed through a length thereof. Threaded hole 80 is sized to threadably engage the threaded shaft 72 of the first axis adjustment screw 18. A mounting projection 82 is formed on an end of the first axis adjustment bar 14 to receive a first object, such as an arrow rest 100. The arrow rest 100 is secured to the first axis adjustment bar 14 with a fastener 86. A second fastener (not shown) is inserted through the attachment slot 28 to secure the attachment bracket 26 to a second object, such as an archery bow. First axis adjustment indicia 88 is formed on a top of the first axis adjustment housing 12. An adjustment bar guide opening 90 is formed through a top of the bar base 62 to display bar adjustment indicia 92 on the first axis adjustment bar 14. A guide rail 94 is formed on a top of the second axis adjustment housing 24 to receive a guide slot 96 formed on a bottom of the bar base 62 to slidably receive the guide rail 94. The locking fastener 22 is inserted through a locking counterbore 98 formed through the bar base 62 of the first axis adjustment housing 12 and threaded into the threaded tap 34 of the second axis adjustment nut 16.

In use, rotation of the first axis adjustment screw 18 causes axial movement of the first axis adjustment bar 14 relative to the first axis adjustment housing 12. Rotation of the second axis adjustment screw 20 causes axial movement of the second axis adjustment nut 20 relative to the second axis housing 24. The first axis adjustment screw 18 is perpendicular to the second axis adjustment screw 20. Once the first and second axis adjustments are made through the first and second axis adjustment screws, the locking fastener 22 is tightened to lock the first and second axis adjustments.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A two axis micro-adjusting device with a single locking mechanism comprising:

a mounting base;

a first axis adjustment housing is slidably retained relative to said mounting base;

a first axis adjustment bar is slidably retained in said first axis adjustment housing;

a locking device for locking an axial position of said first axis adjustment bar and said first axis adjustment housing; and said first axis adjustment housing includes a bar base, a pedestal extension and a screw pedestal, one end of said pedestal extension extends from said bar base, said screw pedestal extends from the other end of said pedestal extension, said first axis adjustment screw is rotatable retained by said pedestal extension.

2. The two axis micro-adjusting device with a single locking mechanism of claim 1, further comprising:

said mounting base includes an attachment bracket.

3. The two axis micro-adjusting device with a single locking mechanism of claim 1, further comprising:

a first axis adjustment screw is rotatably retained in said first axis adjustment housing, rotation of said first axis adjustment screw causes axial movement of said first axis adjustment bar.

4. The two axis micro-adjusting device with a single locking mechanism of claim 1 wherein:

said locking device is a threaded fastener.

5. The two axis micro-adjusting device with a single locking mechanism of claim 1 wherein:

said second axis adjustment housing includes two opposing side block slots and a top nut slot, said two opposing side block slots are sized to slidably receive a rectangular base, said top nut slot is sized to slidably receive said nut post.

6. A two axis micro-adjusting device with a single locking mechanism comprising:

a first axis adjustment housing is slidably retained relative to said mounting base;

a mounting base includes a second axis housing and an attachment bracket extending from said second axis housing, said first axis adjustment housing is slidably retained relative to said second axis housing;

a first axis adjustment bar is slidably retained in said first axis adjustment housing;

a second axis adjustment nut is slidably retained in said mounting base; and a locking device for locking an axial position of said first axis adjustment bar and said first axis adjustment housing;

a first axis adjustment screw is rotatably retained in said first axis adjustment housing, rotation of said first axis adjustment screw causes axial movement of said first axis adjustment bar; and said first axis adjustment housing includes a bar base, a pedestal extension and a screw pedestal, one end of said pedestal extension extends from said bar base, said screw pedestal extends from the other end of said pedestal extension, said first axis adjustment screw is rotatable retained by said pedestal extension.

7. The two axis micro-adjusting device with a single locking mechanism of claim 2, further comprising:

a second axis adjustment nut is slidably retained in said second axis housing.

8. The two axis micro-adjusting device with a single locking mechanism of claim 7, further comprising:

a second axis adjustment screw is rotatably retained in said second axis housing, rotation of said second axis adjustment screw causes axially movement of said second axis adjustment nut.

9. The two axis micro-adjusting device with a single locking mechanism of claim 6, further comprising:

a second axis adjustment nut is slidably retained in said second axis housing.

10. The two axis micro-adjusting device with a single locking mechanism of claim 6, further comprising:

a second axis adjustment screw is rotatably retained in said second axis housing, rotation of said second axis adjustment screw causes axially movement of said second axis adjustment nut.

11. A two axis micro-adjusting device with a single locking mechanism comprising:

a mounting base;

a first axis adjustment housing is slidably retained relative to said mounting base;

a first axis adjustment bar is slidably retained in said first axis adjustment housing;

a locking device for locking an axial position of said first axis adjustment bar and said first axis adjustment housing;

said first axis adjustment housing includes a bar base, a pedestal extension and a screw pedestal, one end of said pedestal extension extends from said bar base, said screw pedestal extends from the other end of said pedestal extension, said first axis adjustment screw is rotatable retained by said pedestal extension; and an adjustment bar guide opening is formed through said bar base to show a position of said first axis adjustment bar.

12. The two axis micro-adjusting device with a single locking mechanism of claim 11, further comprising:

said mounting base includes an attachment bracket.

13. The two axis micro-adjusting device with a single locking mechanism of claim 12, further comprising:

a second axis adjustment nut is slidably retained in said second axis housing.

14. The two axis micro-adjusting device with a single locking mechanism of claim 11, further comprising:

a first axis adjustment screw is rotatably retained in said first axis adjustment housing, rotation of said first axis adjustment screw causes axial movement of said first axis adjustment bar.

15. The two axis micro-adjusting device with a single locking mechanism of claim 13, further comprising:

a second axis adjustment screw is rotatably retained in said second axis housing, rotation of said second axis adjustment screw causes axially movement of said second axis adjustment nut.

16. The two axis micro-adjusting device with a single locking mechanism of claim 11 wherein:

said locking device is a threaded fastener.

17. The two axis micro-adjusting device with a single locking mechanism of claim 11 wherein:

said second axis adjustment housing includes two opposing side block slots and a top nut slot, said two opposing side block slots are sized to slidably receive a rectangular base, said top nut slot is sized to slidably receive said nut post.

* * * * *